United States Patent [19]

Hooker

[11] 4,168,833

[45] Sep. 25, 1979

[54] LIMITED REBOUND MECHANISM

[75] Inventor: Donald E. Hooker, Wilmette, Ill.

[73] Assignee: Bally Manufacturing Company, Chicago, Ill.

[21] Appl. No.: 840,796

[22] Filed: Oct. 11, 1977

Related U.S. Application Data

[63] Continuation-in-part of Ser. No. 686,057, May 13, 1976, abandoned.

[51] Int. Cl.[2] ..... A63F 7/00

[52] U.S. Cl. ..... 273/129 HA

[58] Field of Search ..... 273/127 D, 129 R, 121 R, 273/121 A, 121 D, 121 E, 122 R, 122 A, 123 R, 123 A, 124 R, 124 A, 125 R, 125 A, 55 R, 119 R, 119 A; 124/37

[56] References Cited

U.S. PATENT DOCUMENTS 3,578,324 5/1971 Alvey ..... 273/55 R

*Primary Examiner*—Richard C. Pinkham

*Assistant Examiner*—T. Brown

*Attorney, Agent, or Firm*—Merriam, Marshall & Bicknell

[57] ABSTRACT

A mechanism for limiting the rebound of a rapidly moving game ball of a pin ball-type machine amusement apparatus in which the game ball during its initial traverse along a game board surface engages a movable ball rebound arm having operatively associated therewith a rebound spring adapted to be deflected by the rebound arm and temporarily store in the form of potential energy a limited portion of the initial kinetic energy of a rapidly moving game ball. When the rebound spring has stored as much of the initial kinetic energy of the ball as possible, the rebound arm is adapted to continue to move rearwardly and engage a movable weighted arm which is adapted to be moved rearwardly to dissipate the remaining excess kinetic energy of the ball when the weighted arm is moved rearwardly while the rebound arm is being moved forwardly by the potential energy stored in the rebound spring to affect a rebounding of the ball.

7 Claims, 6 Drawing Figures

LIMITED REBOUND MECHANISM

This is a continuation-in-part application of U.S. Ser. No. 686,057 filed May 13, 1976 now abandoned.

The present invention relates generally to a rebound mechanism for absorbing energy from a moving object and limiting the rebounding of the object, and more particularly to a rebound mechanism which limits the rebound of a game piece, such as a ball of a pin ball-type amusement apparatus.

When operating a pin ball-type amusement apparatus the ball is frequently propelled onto the game board surface at a high velocity and a bumper is conventionally placed in the path of travel of the ball to absorb most of the kinetic energy of the ball before the ball moves downwardly across the play field. Heretofore the bumper has been placed at the upper end of the rounded portion of the game board diagonally opposite the right corner from which the ball is normally propelled so that when the ball strikes the bumper travelling at a high velocity the ball will rebound back and forth between the bumper and a gate member disposed at the opposite end of the rounded upper end portion of the game board surface until the excess kinetic energy is dissipated.

It has been found that in some instances the pin ball game can be made more interesting by limiting the rebound of the game ball onto the play field so that the ball can not enter the openings on the play field forming the uppermost row which frequently have a lower score value than the openings forming the lower rows on the play field. If a conventional rebound bumper is disposed a point along the left lateral edge of the game board surface below the upper row of holes, the ball might be rebounded onto the play field without the ball travelling across the upper row of openings. However, when the rebound bumper is so placed on the game board surface the ball is frequently rebounded onto the play field with such force that the pins on the play field of a pinball-type game board or other parts of the mechanism are damaged.

It is therefore an object of the present invention to provide a rebound mechanism which is adapted to convert into potential energy a limited amount of the initial kinetic energy of a game piece moving along a support surface and thereafter rebounding the game piece with a force which is equal to only the limited amount of potential energy and which is substantially less than its initial amount of kinetic energy of the game piece.

It is a further object of the present invention to provide a rebound device for limiting to a predetermined maximum the velocity at which a play piece of an amusement apparatus is rebounded onto the play field of the amusement apparatus.

It is still another object of the present invention to provide a rebound limiting mechanism for an amusement apparatus for engaging a play piece which enters onto the game board surface at a high velocity and rebounding the play piece onto the play field with a predetermined limited lower velocity.

It is another object of the present invention to provide a pin ball machine having a ball rebound mechanism which temporarily stores a limited portion of the initial kinetic energy of the ball and dissipates all the kinetic energy of a ball in excess of the predetermined limited amount of kinetic energy temporarily stored and thereafter rebounds the ball onto the play field with said limitation portion of kinetic energy.

It is also an object of the present invention to provide a pin ball machine having a rebound mechanism which is disposed and arranged so that the game ball when travelling at a high velocity on entering the game board surface is rebounded onto the play field so that the ball will not enter the holes forming the uppermost row of the play field or contact the pins associated therewith.

Other objects of the present invention will be apparent to those skilled in the art from the description and allowing claims when read in conjunction with the accompanying drawing wherein:

Figure 1:
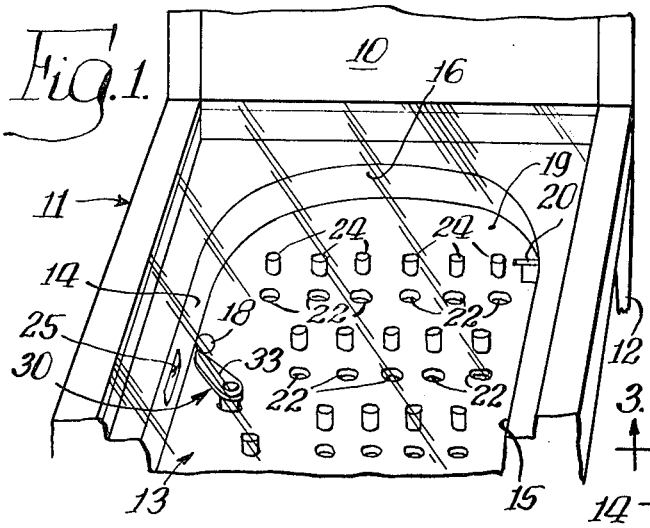
FIG. 1 is a fragmentary perspective view of a pin ball machine embodying the present invention.
Figure 2:
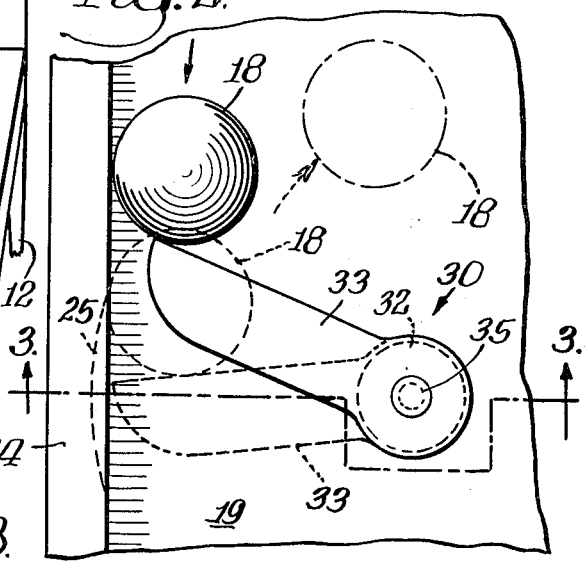
FIG. 2 is a fragmentary top plan view of the playing surface of the pin ball machine of FIG. 1.
Figure 3:
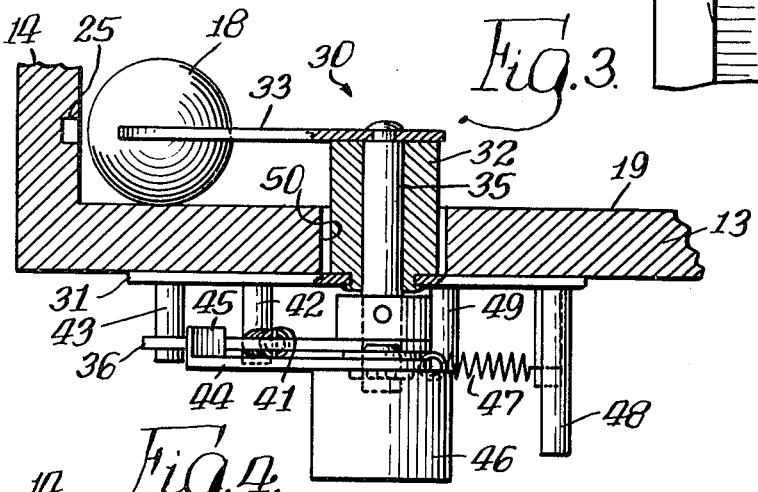
FIG. 3 is a fragmentary vertical sectional view taken along the line 3—3 of FIG. 2 partially in elevation.

The foregoing objects of the presnt invention are achieved by providing a rebound mechanism disposed in the path of a moving game piece, such as a game ball of a pin ball apparatus, moving along the surface of a game board, so that the game piece is rebounded onto the play field of the game board at a controlled velocity substantially less than its initial velocity by temporarily storing a limited amount of the initial kinetic energy of the moving game piece above a predetermined value and dissipating all the kinetic energy of the game piece above that which is temporarily stored by effecting movement of a movable object having a mass approximately the same as the mass of the game piece, and rebounding the game piece onto the play field with the said predetermined kinetic energy.

The applicant's invention is illustrated as embodied in a rebound mechanism for a pin ball-type apparatus and comprises a combination of mechanical elements wherein a limited amount of kinetic energy of a rapidly moving pin ball or game piece travelling along the supporting surface of a pin ball-type game board is converted to potential energy when a rapidly moving pin ball strikes the rebound mechanism by temporarily storing a limited amount of the kinetic energy of the rapidly moving pin ball in a resilient means, such as a rebound spring element of the energy storing means of the rebound mechanism. Any kinetic energy in excess of the limited amount of energy stored in the rebound spring element is dissipated by using the excess kinetic energy to move a weighted element associated with an energy absorbing or dissipating means of the rebound mechanism so that the excess kinetic energy is not returned to the game ball. Since only the potential energy of the tensioned rebound spring will be converted back to kinetic energy to effect rebounding the pin ball and none of the kinetic energy which has been consumed by moving the weight element will be returned to the pin ball no matter how great the velocity of the pin ball when it initially contacts the rebound mechanism, the rebound velocity of the pin ball will be limited to the energy temporarily stored in the rebound spring. In the rebound mechanism the energy storing means is preferably a spring biased pivotally movable means adapted to be engaged by said moving game piece on said supporting game board surface, and said energy absorbing or dissipating means is preferably a spring biased pivotally movable weighted means adapted to be engaged by said energy storing means whenever the kinetic energy of said moving object exceeds the level of energy which can be stored in said energy storing means.

In operation of the applicant's claimed rebound mechanism, whenever the pin ball has a velocity such that the rebound spring is deflected to a maximum by the ball striking and moving a rebound arm associated with the rebound spring element and there is still more kinetic energy in the ball than the rebound spring is adapted to store, than the arm is adapted to continue moving until it strikes a weighted element associated with the energy dissipating means whose mass is preferably about equal to that of the game ball. At this point, all the excess kinetic energy of the game ball which has not been converted into potential energy by the rebound spring will be transferred to the energy dissipating means and be completely dissipated by effecting movement of the weighted element. Since the pin ball which remains in contact with the rebound arm until rebounded will then have no kinetic energy, the rebound spring will contract, transferring its potential energy into kinetic energy, and will rebound the game ball with a force equal only to the limited amount of energy which has been temporarily stored in the rebound spring.

The game ball rebound mechanism 30 comprising a base plate 31 which is secured to the lower surface of the game board 13 by suitable fastener means. The base plate 31 has affixed thereto a bushing 32 which extends perpendicularly through a passage 50 formed in the game board 13. A game ball-engaging rebound arm 33 is secured to a pivot pin 35 which is pivotally movable in the bushing 32. The ball rebound arm 33 is operatively disposed directly in the normal path of the game ball 18 during the ball's initial traverse over the surface of the game board 13. A lower arm 36 is also affixed to the pilot pin 35 in bushing 32 so that rebound arm 33, pin 35 and lower arm 36 are pivotally movable as a unit. The lower arm 36 is operatively connected with an energy storing element, such as the rebound spring 41, which is anchored at one end to the base plate 31 through a post 42 extending downwardly from the undersurface of the base plate 31 with the other end of spring 41 attached to the lower arm 36 fixedly secured to the pivot pin 35. The rebound spring 41 serves as a biasing spring to maintain the rebound arm 33 and the lower arm 36 in its normal at rest position (See FIG. 4) with the lower arm 36 in contact with a stop member 43 which extends downwardly from the base plate 31. The ball rebound arm 33 is adapted to be moved pivotally rearwardly from its normal rest position by the force of the game ball striking the forward surface thereof. A slot 25 is formed in the side wall 14 to accommodate the end of the ball rebound arm 33 during pivotal movement thereof. If the game ball 18 initially does not have more than a given amount of kinetic energy (i.e. travelling below a predetermined velocity) when making initial contact with the rebound arm 33, the rebound spring 41 will be deflected and temporarily store as potential energy all the kinetic energy of the game ball 18 when the lower arm 36 is moved pivotally rearwardly from its normal rest position. The rebound arm 33 is adapted to be returned to its normal rest position by the potential energy stored in the rebound spring 41 when the game ball loses all of its initial kinetic energy and will impart to the ball 18 a limited rebound onto the play field 19. And, the maximum amount of potential energy which can be stored by the rebound spring 41 is preferably such that the ball 18 will not be rebounded with a force which will cause the ball to roll into the uppermost row of openings 22 or contact the pins 24 associated with the uppermost row of openings 22 on the play field 19.

When the ball is travelling at a high velocity when initially making contact with the rebound arm 33, the lower arm 36 is moved rearwardly away from its normal rest position by a force greater than can be stored in the rebound spring 41 and will continue to move pivotally rearwardly until contacting an energy absorbing or dissipating means which in the preferred embodiment shown comprises a pivotally movable weighted arm 44. The weighted arm 44 has an abutment surface 45 formed on one end thereof which is adapted to be engaged by the lower arm 36. A weight 46, preferably having a mass approximately equal to the mass of the game ball 18, is secured to the weighted arm 44. The weighted arm 44 is mounted for pivotal movement on the pivot pin 35 independently of the pivotal movement of arms 33 and 36.

The kinetic energy remaining in the game ball 18 which is not stored in the rebound spring 41 is absorbed and completely dissipated essentially by effecting movement of the mass of the weighted arm 44 and to only a very minor extent by the biasing force of the reset spring 47 which is designed only to return the arm 44 to its normal rest position. The stop members 48, 49 are provided to limit the pivotal movement of the weighted arm 44. After the game ball 18 has lost all its kinetic energy, the lower arm 36 and the ball rebound arm 33 are returned to normal rest position with a force limited substantially to the energy stored in the rebound spring 41; thereby effecting the desired limited rebound of the ball 18 onto the play field 19. The weighted arm 45 is returned to its normal rest position by the reset spring 47.

Figure 4:
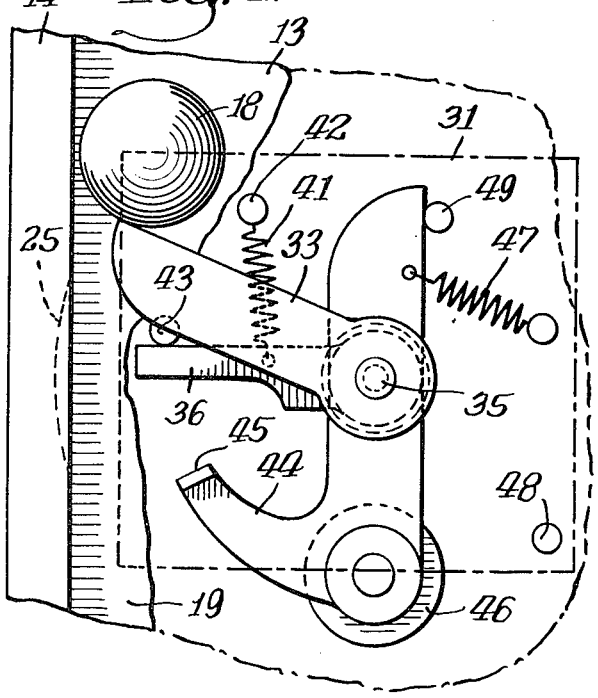
FIG. 4 is a fragmentary top plan view of the ball rebound mechanism of FIG. 1.
Figure 5:
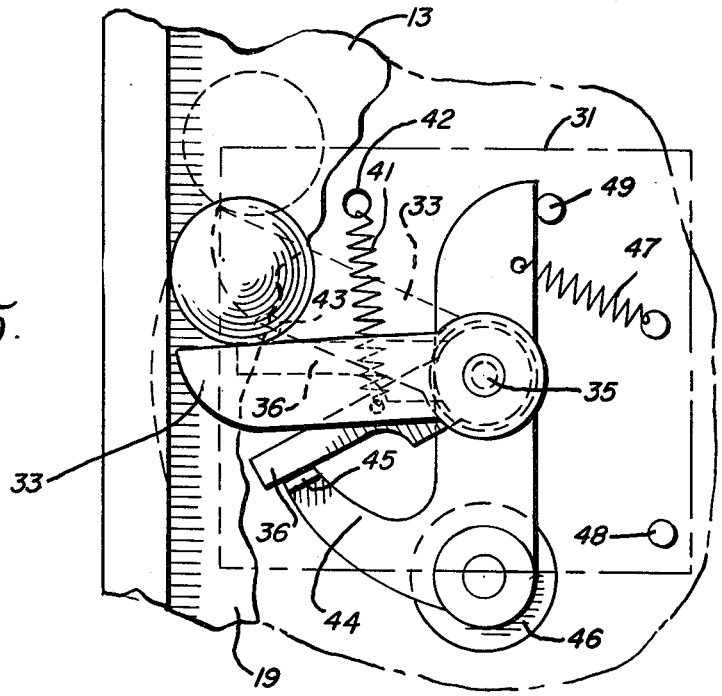
FIG. 5 is a fragmentary top plan view of the ball rebound mechanism of FIG. 1 in another operative position.

In operation when a game ball is released on the playing surface at a relatively high rate of speed and the rapidly moving ball contacts the rebound arm 33 in normal rest position as shown in FIG. 4, the rebound arm 33 is moved pivotally rearwardly at a rapid rate by the kinetic energy of the rapidly moving ball. The rearwardly movement of the rebound arm 33 causes the lower arm 36 associated therewith to also move rearwardly at a rapid rate against the tension of the spring 41. After the spring 41 has been substantially fully tensiond and has temporarily stored therein as potential energy a portion of the initial kinetic energy of the rapidly moving ball and while there is still kinetic energy remaining in the ball which would normally cause the rebound arm 33 and lower arm 36 to continue rapid rearwardly movement, the lower arm 36 contacts an abutment surface 45 formed on a pivotally movable weighted arm 44, as shown in FIG. 5. The relationship of the respective parts at the moment the lower arm 36 contacts the abutment surface 45 is shown in full line in FIG. 5 with the normal "at rest" position of the rebound arm 33 being shown in dotted line.

Figure 6:
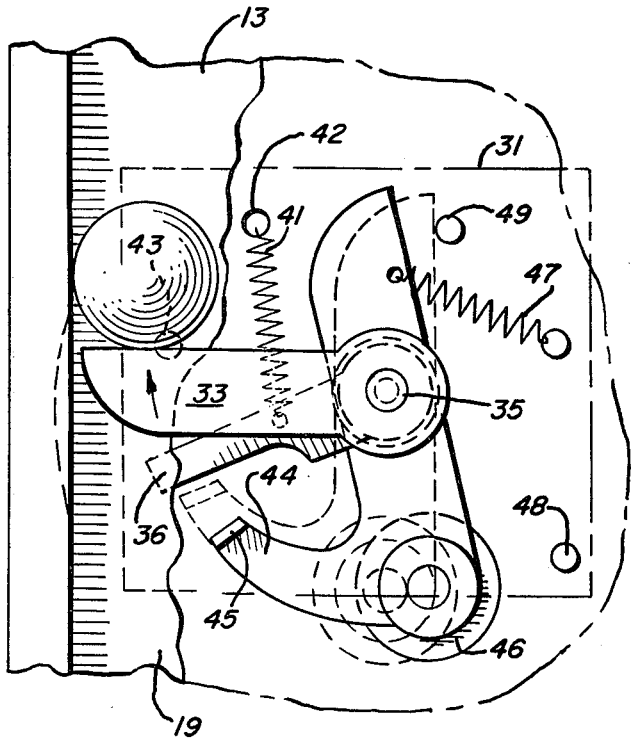
FIG. 6 is a fragmentary top plan view of the ball rebound mechanism of FIG. 1 of still another operative position.

When the rapidly moving lower arm 36 strikes the abutment surface 45, the weighted arm 44 is moved pivotally rearwardly away from it normal rest position shown in dotted line in FIG. 6. At the same instant the rearwardly movement of the lower arm 36 together with rebound arm 33 and ball 18 are abruptly stopped, since the mass of the weighted arm 44 is selected so as to be about equal to the mass of the ball together with the mass of the lower arm 36 and rebound arm 33, although normally the weight of the arms 33 and 36 are relatively small and therefore will generally be negligible. And, since the lower arm 36 is under tension of the spring 41 urging the lower arm 36 forwardly toward its normal rest position and away from the point of impact with the weighted arm 44, the lower arm 36 and the rebound arm 33 swing forwardly together away from the weighted arm 44 under the tension of the spring 41 and effecting the rebound of the ball while the weighted arm 44 is moving rearwardly away from its normal rest position in an opposite direction from the forwardly moving rebound arm 33 and with the lower arm 36 being completely out of contact with the weighted arm 44 during the rebounding of the ball. Thus, the weighted arm 44 exerts no rebounding force on the game ball which is rebounded entirely by the energy temporarily stored in the spring 41. The relative position of the parts of applicant's preferred form of rebound apparatus during the rebounding and after the lower arm 36 has made contact with the abutment surface 45 is shown in full line in FIG. 6. In the foregoing manner all the excess kinetic energy not temporarily stored in the spring element 41 is transferred to the weight element, and the excess energy is completely dissipated by effecting pivotal rearwardly movement of the weighted element 44.

It will be clear from the foregoing that the only forwardly or rebounding force applied to the game ball through the lower arm 36 and rebound arm 33 is that force exerted by the tensioned spring 41 and that the ball 18 is rebounded with a velocity restricted entirely to the limited amount of initial kinetic energy temporarily stored in the rebound spring 41, and none of the kinetic energy expended in moving the weighted arm 44 rearwardly away from its normal rest position is used to effect the rebounding of the game ball.

While the rebound limiting mechanism of the present invention has been shown specifically embodied in a pin ball machine, it should be understood that the present invention can be used to limit the rebound in other apparatus in which an object moves over a supporting surface at a high velocity, such as in a shuffle board amusement device, by enlarging the size and strength of the respective parts comprising the mechanism.

I claim:

1. A rebound mechanism for a game piece moving along a surface of a game board with a given initial kinetic energy comprising:

(1) an energy storing means adapted to be engaged by said game piece moving along said surface and moved from a normal rest position to effect temporarily storing therein as potential energy a limited amount of said initial kinetic energy of the moving game piece;

(2) an energy absorbing means having an energy absorbing element spaced from said energy storing means when in a normal rest position;

(3) said energy storing means adapted to be moved into engagement with said energy absorbing means when engaged by same game piece and effect movement of said energy absorbing element away from its normal rest position after said energy storing means has temporarily stored all said limited amount of initial kinetic energy which is adapted to be stored therein; and (4) said energy storing means being adapted to return to the normal rest position thereof while said energy absorbing element is out of contact with said energy storing means; whereby the game piece is rebounded with a maximum force equal to the limited amount of kinetic energy temporarily stored in said energy storing means.

2. A rebound mechanism as in claim 1, wherein said energy storing means comprises a spring biased pivotally movable rigid element, and said energy absorbing element comprises a pivotally movable rigid weighted element.

3. A rebound mechanism for a ball moving along a supporting surface with a given amount of initial kinetic energy comprising, an energy storing means having a movable element which is adapted to be moved from a normal rest position thereof when contacted by a moving ball and temporarily store a limited amount of said initial kinetic energy of said moving ball in a spring element associated with said movable element, an energy absorbing means having associated therewith a weighted element which in a normal rest position is spaced from said movable element, said movable element adapted to engage said weighted element only after said spring element has stored all said limited amount of kinetic energy adapted to be stored therein and while said weighted element is in said normal rest position to effect movement of said weighted element away from said normal rest position, and said spring element being adapted to return said movable element to a normal resting position thereof and effect the rebounding of said ball while said weighted element is moving away from the normal rest position thereof; whereby said ball is rebounded only by the limited amount of kinetic energy temporarily stored in said energy storing means.

4. A rebound mechanism for limiting the rebound of a ball moving along a supporting surface comprising, an energy storing means which is adapted to be contacted by a moving ball when the ball is propelled onto a playing surface with a given initial kinetic energy, said energy storing means having a movable element which is adapted to be displaced from a normal rest position by the said ball and which effects deflection of a spring element with the said deflection effecting temporarily storage in said spring element of a limited amount of the initial kinetic energy of said ball, a movable weighted element having an abutment surface spaced from said movable element when said weighted element and said movable element are disposed in their normal rest positions, said movable element adapted to strike said abutment surface of said weighted element while said weighted element is in a normal resting position only after all said limited amount of kinetic energy which is adapted to be stored in said spring element has been stored therein and thereby effect movement of said weighted element away from said normal resting position thereto, and said movement of said weighted element dissipating all the remaining kinetic energy of said ball, and said spring element being adapted to return said movable element into said normal rest position thereof by moving said movable element in a direction opposite to the direction of movement of said weighted element after said weighted element is struck by said movable element; thereby rebounding said game ball along said game board surface with only said limited amount of kinetic energy temporarily stored in said spring element.

5. A rebound mechanism as in claim 4, wherein said energy storing means is comprised of spring biased rigid pivotally movable member and said weighted element is a rigid pivotally movable weighted arm.

6. In an amusement apparatus, a rebound mechanism for limiting the rebound of an object moving along a supporting playing surface with a given initial kinetic energy comprising, a rebound arm pivotally movable about an axis which extends perpendicularly above and below said supporting surface and adapted to be engaged and moved pivotally by said object moving along said supporting surface, said rebound arm having a lower arm operatively associated therewith disposed below said supporting surface and movable pivotally about said axis with said rebound arm from a normal rest position to a position rearwardly thereof, said lower arm having an energy storing element operatively associated therewith which is adapted to temporarily store therein a limited amount of said initial kinetic energy of the moving object, said energy storing means adapted to urge said lower arm and said rebound arm toward said normal rest position in opposition to a force applied to said rebound arm by said moving object, a weighted arm mounted for pivotal movement independently of said rebound arm and said lower arm from a normal rest position to a position rearwardly thereof, said weighted arm being provided with an abutment surface which in the normal rest positions of said lower arm and said weighted arm is spaced rearwardly of said lower arm, said lower arm adapted to be moved into contact with said abutment surface only after all said limited amount of initial kinetic energy adapted to be stored in said energy storing element has been stored therein, said lower arm when moved into contact with said abutment surface adapted to transfer all the kinetic energy remaining in said object to said weighted arm by effecting pivotal movement of said weighted arm away from the said normal rest position thereof, and said energy storing element adapted to return said rebound arm into the normal rest position thereof by moving said lower arm in a direction opposite to said movement of said weighted arm after said lower arm has contacted said abutment surface and effected said transfer of all the kinetic energy remaining in said object to said weighted arm; thereby effecting the rebound of said object along said supporting surface with a force limited only to the energy stored in said energy storing element.

7. In a pin ball-type amusement apparatus, a rebound mechanism for limiting the rebound of an object moving along a supporting surface with a given initial kinetic energy comprising, a rebound arm pivotally movable about an axis which extends perpendicularly above and below said supporting surface and adapted to be engaged by said object moving along said supporting surface, said rebound arm having a lower arm operatively associated therewith disposed below said supporting surface and movable pivotally about said axis with said rebound arm from a normal rest position to a position rearwardly thereof, said lower arm having an energy storing element operatively associated therewith for urging said lower arm and said rebound arm toward said normal rest position in opposition to a force applied to said rebound arm by said moving object, a weighted arm mounted for pivotal movement about said axis independently of said lower arm from a normal rest position to a position rearwardly thereof, said weighted arm having an abutment surface formed on an end thereof which in said normal rest positions of said lower arm and said weighted arm is spaced rearwardly of said lower arm, said abutment surface adapted to be engaged by said lower arm when said lower arm is moved pivotally rearwardly after transfer of a part of said initial kinetic energy to said energy storing element, said weighted arm adapted to absorb the kinetic energy remaining in said object after said lower arm is moved rearwardly into contact with said abutment surface, and thereafter said energy storing element being adapted to return said lower arm and said rebound arm while said object remains in engagement therewith to normal rest position with a force limited substantially to the energy stored in said energy storing element.

* * * * *